US012392155B2

(12) United States Patent
Bernini

(10) Patent No.: US 12,392,155 B2
(45) Date of Patent: Aug. 19, 2025

(54) SWIMMING POOL CLEANING SYSTEM

(71) Applicant: Fabrizio Bernini, Bucine (IT)

(72) Inventor: Fabrizio Bernini, Bucine (IT)

( * ) Notice: Subject to any disclaimer, the term of this patent is extended or adjusted under 35 U.S.C. 154(b) by 597 days.

(21) Appl. No.: 17/700,015

(22) Filed: Mar. 21, 2022

(65) Prior Publication Data

US 2022/0298818 A1 Sep. 22, 2022

(30) Foreign Application Priority Data

Mar. 22, 2021 (IT) ..... 102021000006875

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; E04H 4/1218; B63B 35/00
USPC ..... 210/167.16, 210.17; 15/1.7
See application file for complete search history.

(56) References Cited

U.S. PATENT DOCUMENTS 4,221,662 A * 9/1980 Joseph ..... E04H 4/1254 210/167.18
10,294,686 B1 * 5/2019 Erlich ..... B63H 11/04
10,450,769 B2 * 10/2019 Londono ..... A47L 7/0004
10,876,315 B2 * 12/2020 Pichon ..... E04H 4/144
10,982,456 B2 * 4/2021 Witelson ..... H02J 50/10
2004/0173542 A1 * 9/2004 Porat ..... E04H 4/1272 210/192
2014/0263087 A1 * 9/2014 Renaud ..... E04H 4/1654 210/745
2018/0142484 A9 * 5/2018 Smith ..... E04H 4/1263
2019/0271169 A1 * 9/2019 Witelson ..... E04H 4/1654
2020/0056391 A1 * 2/2020 Lancry ..... B25J 11/0085

FOREIGN PATENT DOCUMENTS

EP 3540150 A1 9/2019
EP 3696345 A1 * 8/2020 ..... B63H 11/113

OTHER PUBLICATIONS

Italian Search Report dated Nov. 16, 2021 from counterpart Italian Patent Application No. 102021000006875.

* cited by examiner

*Primary Examiner* — Fred Prince
(74) *Attorney, Agent, or Firm* — SHUTTLEWORTH & INGERSOLL, PLC; Timothy J. Klima

(57) ABSTRACT

A system for cleaning swimming pools, includes a robot which includes a main body, a plurality of electric rotors supported by the main body and configured for generating a hydrodynamic thrust designed to move the robot inside the volume of water of a swimming pool, an electricity storage unit for powering the rotors, and a device for cleaning the swimming pool. The system also includes a recharging base of the electricity storage unit.

13 Claims, 6 Drawing Sheets

SWIMMING POOL CLEANING SYSTEM

This application claims priority to Italian Patent Application 102021000006875 filed Mar. 22, 2021, the entirety of which is incorporated by reference herein.

This invention relates to the technical sector of devices for maintenance operations, such as, for example, cleaning swimming pools.

More specifically, the invention relates to a cleaning system comprising a self-propelled autonomous unit, or robot, for cleaning swimming pools.

Yet more specifically, the invention relates to a cleaning system comprising a robot operating with a battery and a recharging base for the relative batteries.

There are currently prior art cleaning systems comprising self-propelled apparatuses which, after having been immersed in a swimming pool, can move on the bottom and on the walls of the swimming pool to perform a cleaning operation on them, for example, using brushes and/or suitable suction circuits which allow detritus present in the water such as leaves or small insects to be removed.

Prior art robots are configured to reach the bottom wall of the swimming pool in which they operate and slide on it thanks to rotary elements, the action of which is assisted by suitable generators of a hydrodynamic thrust facing perpendicularly to the supporting wall on which the robot must slide, in such a way as to improve its adherence to it.

During the operations for cleaning the swimming pool the robot collects, using the above-mentioned cleaning means, all the foreign elements which it encounters on its path.

There are also prior art robots which are able to also move on the side walls of the swimming pool, in this way allowing all the surfaces to be treated.

In other words, the rotors allow the immersion of the robot to be assisted (when necessary) and to keep it adherent with the wall of the swimming pool on which they must slide, whilst their movement along the feed trajectory on that surface is obtained by means of the rotary elements coupled to the main body of the robot.

Prior art robots mainly have an electricity supply cable and sometimes also a suction pipe connected to a centralised suction unit which draws water into itself picked up by the robot, filtering it and re-introducing it into the swimming pool once clean.

These flexible connections make the use of the cleaning robot not always practical and efficient due to their overall size which constitutes an evident obstruction to the movement of the users and also due to their not very pleasant appearance.

Battery cleaning robots have also been developed, which therefore do not have at least the power cable, which, however, have not been free from drawbacks.

For example, it has not been easy to provide in a practical and effective manner for the recharging of batteries mounted on the robot.

In this context, the technical purpose which forms the basis of the invention is to provide a system for cleaning swimming pools which overcomes the above-mentioned drawbacks of the prior art.

More specifically, the aim of the invention is to provide a cleaning system which is able to provide in a practical, safe and effective manner for the power supply of the cleaning robot.

A further aim of the invention is to provide a system for cleaning swimming pools which is practical to install and easy to use.

According to the invention, these aims and others are achieved by a swimming pool cleaning system comprising the technical features described in the accompanying claims.

The technical features of the invention, according to the above-mentioned aims, are clearly described in the appended claims and its advantages are apparent from the detailed description which follows, with reference to the accompanying drawings which illustrate a non-limiting example embodiment of it, and in which:

Figure 1:
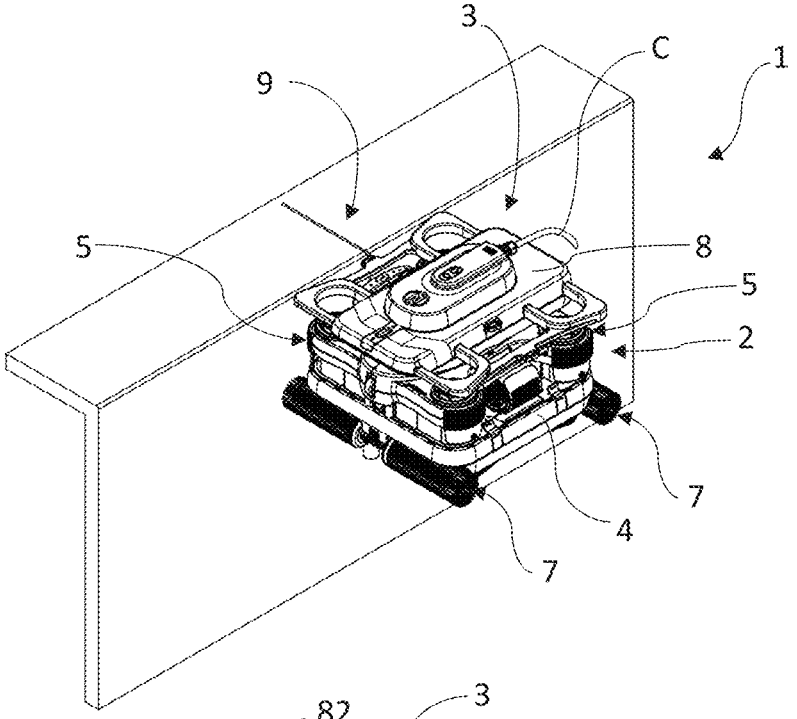
FIG. 1 is a schematic perspective view from above of an embodiment of the cleaning system according to the invention in a first configuration of use.
Figure 2:
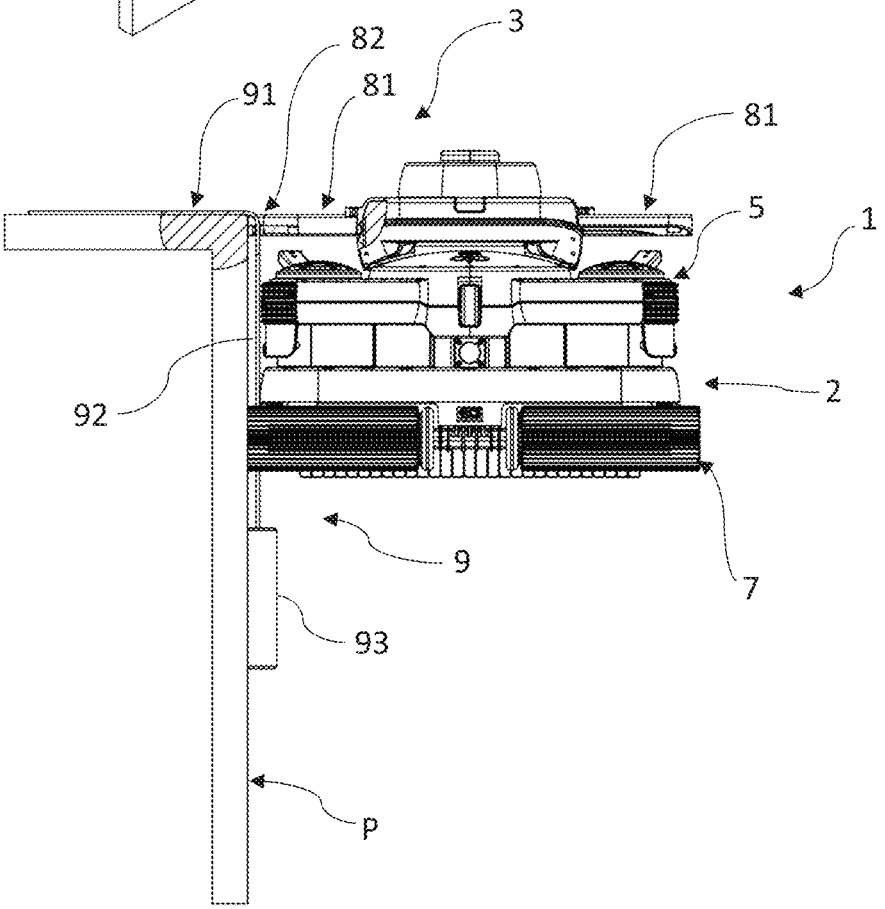
FIG. 2 is a schematic side elevation view of the cleaning system of FIG. 1.
Figure 7:
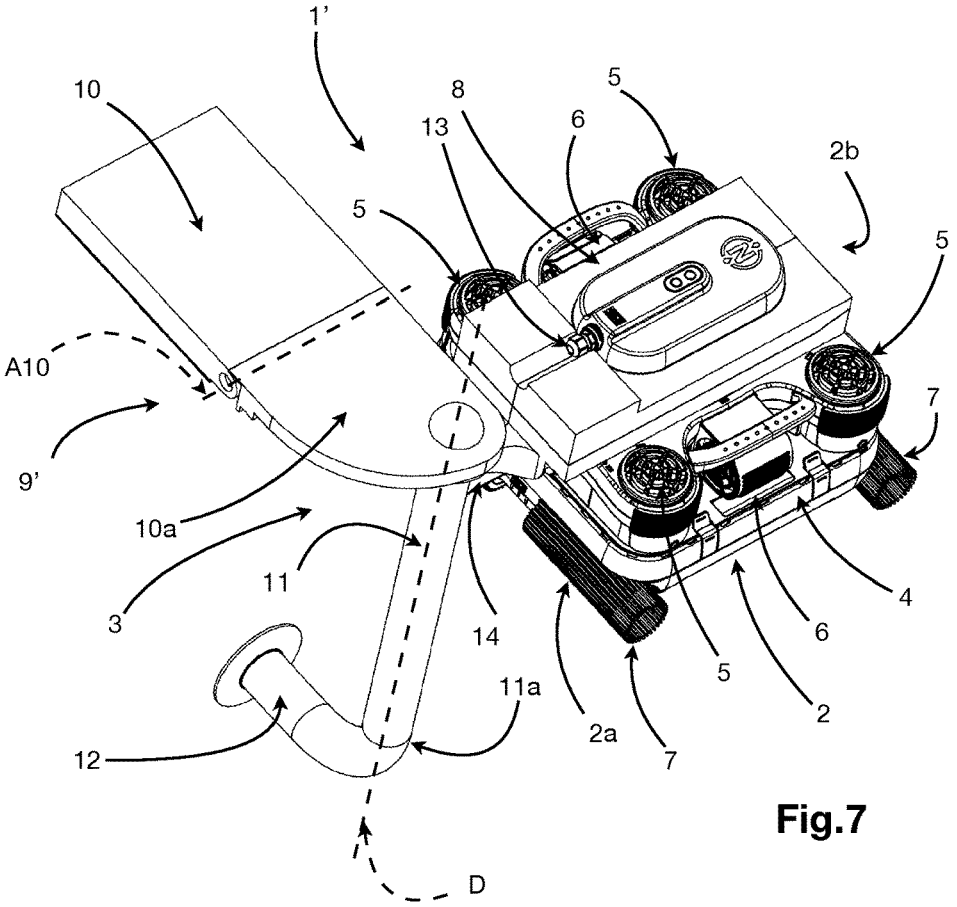
FIG. 7 is a schematic perspective view from above of the cleaning system according to the invention in a particular configuration of use.
Figure 8:
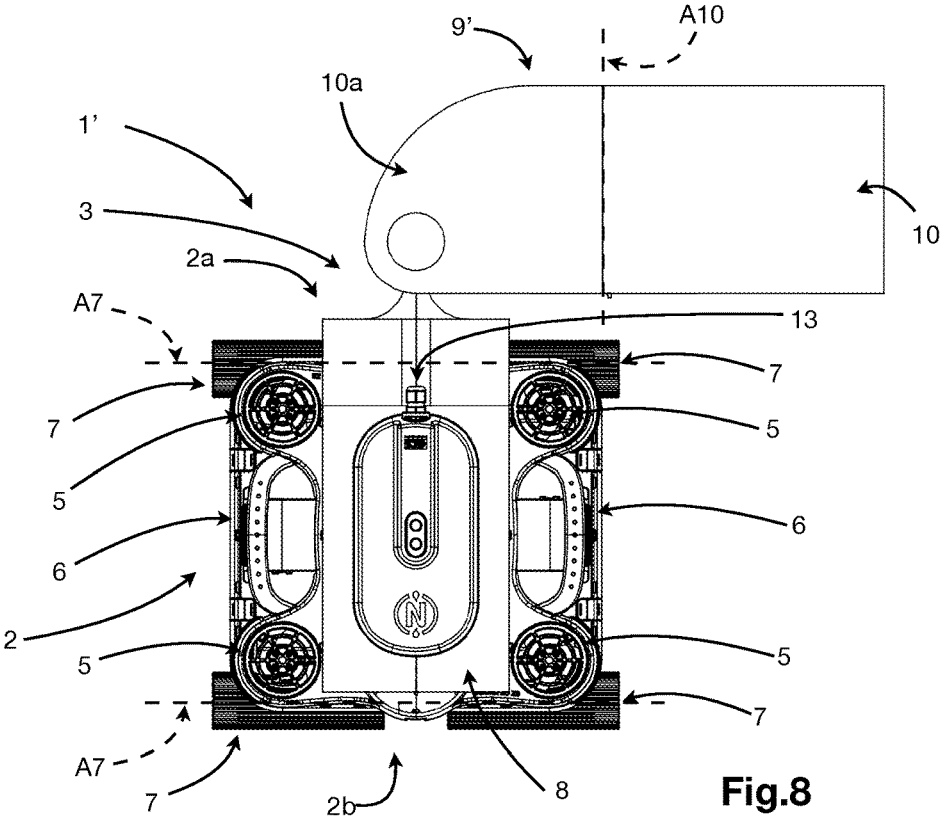
FIG. 8 is a top plan view of the cleaning system of FIG. 1.

As illustrated in FIGS. 1 and 7, the numeral 1, 1' denotes in their entirety two embodiments of a system for cleaning swimming pools, made according to the invention.

The cleaning system 1, 1', hereinafter also referred to simply as the system 1, 1' comprises a robot 2 operated electrically by means of an electricity storage unit, and a station 3 for recharging the storage unit.

The robot 2 is a self-propelled robot, that is, movable in a substantially autonomous manner inside a swimming pool, not illustrated, in particular for performing an operation for cleaning the walls of the swimming pool and the entire volume of water present inside it.

In the accompanying drawings the robot 2 is shown moored to the recharging station 3, meaning that it will detach itself during the normal operations for cleaning the swimming pool.

As illustrated in FIGS. 1 to 6 and from 7 to 10, the robot 2 comprises a main body 4 and a plurality of electric rotors 5, 6 configured to generate a hydrodynamic thrust designed to move the robot 2 inside the volume of water of the swimming pool.

According to the preferred embodiment of the robot 2 illustrated in the accompanying drawings, the main body 4 has an overall size at least approximately in the shape of a parallelepiped and four rotors 5 of the above-mentioned plurality are positioned at respective vertices of the parallelepiped, substantially at the same height relative to the main body 4.

The rotors 5 positioned at the vertices have a vertical axis of rotation and are configured to basically generate a substantially vertical hydrodynamic thrust designed to operate variations in height of the robot 2.

The robot 2 advantageously comprises two further rotation rotors 6 positioned along two opposite sides of the main body 4.

The rotation rotors 6 are configured to generate a hydrodynamic thrust which is able to promote a rotation of the robot about an axis of rotation which is substantially vertical relative to the water surface of the swimming pool.

Advantageously, the rotation rotors 6 are configured to generate a substantially horizontal hydrodynamic thrust which, as well as promoting a rotation of the robot 2, may also favour a forward movement.

The hydrodynamic thrust generated by the rotors 5, 6 therefore has, substantially, a vertical component and a horizontal component such as to allow the generation of a three-dimensional trajectory inside the entire volume of the swimming pool.

In other words, the plurality of rotors 5, 6 makes it possible to modify, even simultaneously, both the feed direction of the robot 2 and its height relative to the surface of the water contained in the swimming pool.

The robot 2 comprises, not illustrated and housed inside its main body 4, an electricity storage unit for powering said rotors 5, 6.

The above-mentioned and not illustrated electricity storage unit is advantageously housed inside a watertight containment space, not visible in the accompanying drawings, formed in the main body 4.

Advantageously, a computerised unit for command and control of the operation of the robot 2, not illustrated, is contained inside the above-mentioned and not illustrated sealed containment space.

As illustrated in the accompanying drawings, the robot 2 also comprises a plurality of rotary brushes 7, designed to operate on the surfaces of the swimming pool to remove dirt and impurities which adhere to these surfaces.

The rotary brushes 7, in accordance with the embodiment illustrated of the robot 2, are positioned in pairs, respectively at a front zone 2*a* and a rear zone 2*b* of the robot 2.

The rotary brushes 7 of each pair rotate about a same substantially horizontal axis A7.

The above-mentioned rotary brushes 7 define in their entirety, for the system 1 according to the invention, respective means for cleaning the swimming pool.

Advantageously, according to embodiments not illustrated, the above-mentioned cleaning means may comprise, as an alternative to or in addition to the rotary brushes 7, abrasive elements or brushes of the static type, water suction means, if necessary combined with respective means for filtering the water sucked in.

Also depending on the type of cleaning means installed on the robot 2, the performance of an operation for cleaning the swimming pool can be carried out in different ways, by removing debris and impurities, whether they are deposited on the walls of the swimming pool or if they are in suspension in portions of water far from the walls.

As illustrated in the accompanying drawings, the recharging station 3 comprises a recharging base 8 for the above-mentioned and not illustrated unit for storing electricity of the robot 2.

The recharging base 8 is floating and, as described in detail below, is designed to remain stably at the surface of the volume of water contained in the swimming pool.

As clearly illustrated in particular in FIGS. 1 to 6, the recharging station 3 of the system 1 comprises a flexible connecting element 9 which is able to guarantee a stable connection of the recharging station 3 with an edge B of the swimming pool.

The flexible connecting element 9 is shown schematically in FIGS. 1 to 6, and is one between a cable, a cord, a belt, a chain with rings and an articulated chain.

The flexible connecting element 9 comprises a first portion 91 connected, in a manner not illustrated, to the edge B of the swimming pool and partly lying on it, which is connected to the floating recharging base 8.

The flexible connecting element 9 comprises a second portion 92 extending from the floating recharging base 8 to submerge in the water.

At a lower end of its second portion 92, the flexible connecting element 9 comprises a weight 93 designed to keep under tension the flexible element 9.

The main function of the weight 93 is also that of imparting stability to the floating recharging base 8.

As illustrated in FIGS. 1 to 6, the recharging base 8 has a substantially quadrangular shape and has, on two opposite sides of it, two respective projections 81 designed to keep the recharging base 8 at a predetermined distance from the vertical wall P of the swimming pool, so as to allow an easy return of the robot 2 towards the recharging base 8.

In effect, by using suitable sensors of substantially known type and not described further, the robot 2 is able to advance, in an immersed configuration and exploiting its buoyancy, in contact with the vertical wall P until reaching the recharging base 8 and engage with it also thanks to a possible guide zone, not visible in the accompanying drawings, made either on the robot 2 or on the recharging base 8.

On the above-mentioned projections 81 there are a first engagement and movement element 82 and a second engagement and movement element 83 for engaging and moving the above-mentioned flexible connecting element 9.

The first and second engagement and movement elements 82, 83 are designed to slidably retain and move the flexible connecting element 9 so as to ensure, at the same time, a stable connection of the recharging base 8 relative to the edge B and also an efficient and practical adjustment of the length of the connection, depending on the size of the edge B and the water level in the swimming pool.

Figure 3:
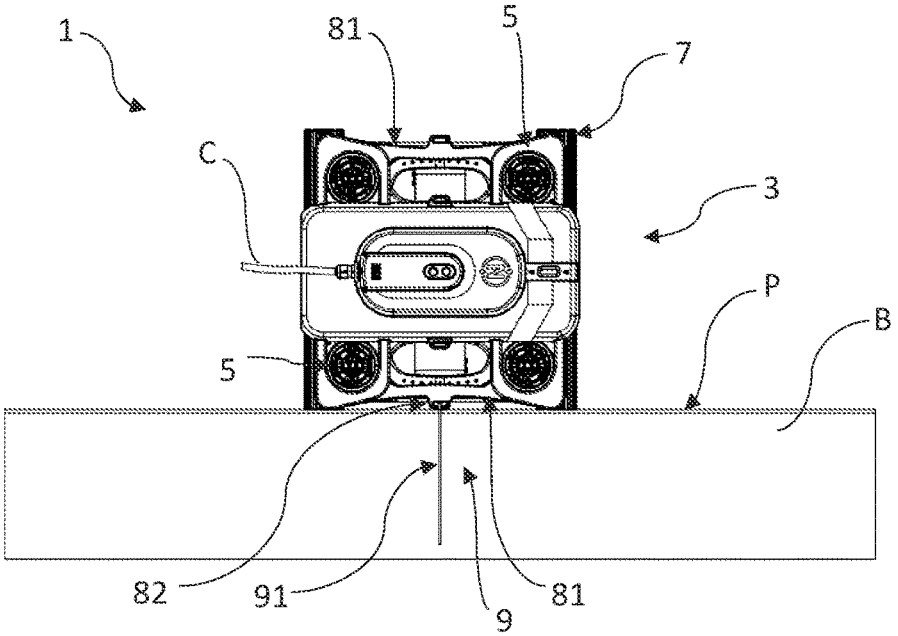
FIG. 3 is a top plan view of the cleaning system of FIGS. 1 and 2.
Figure 4:
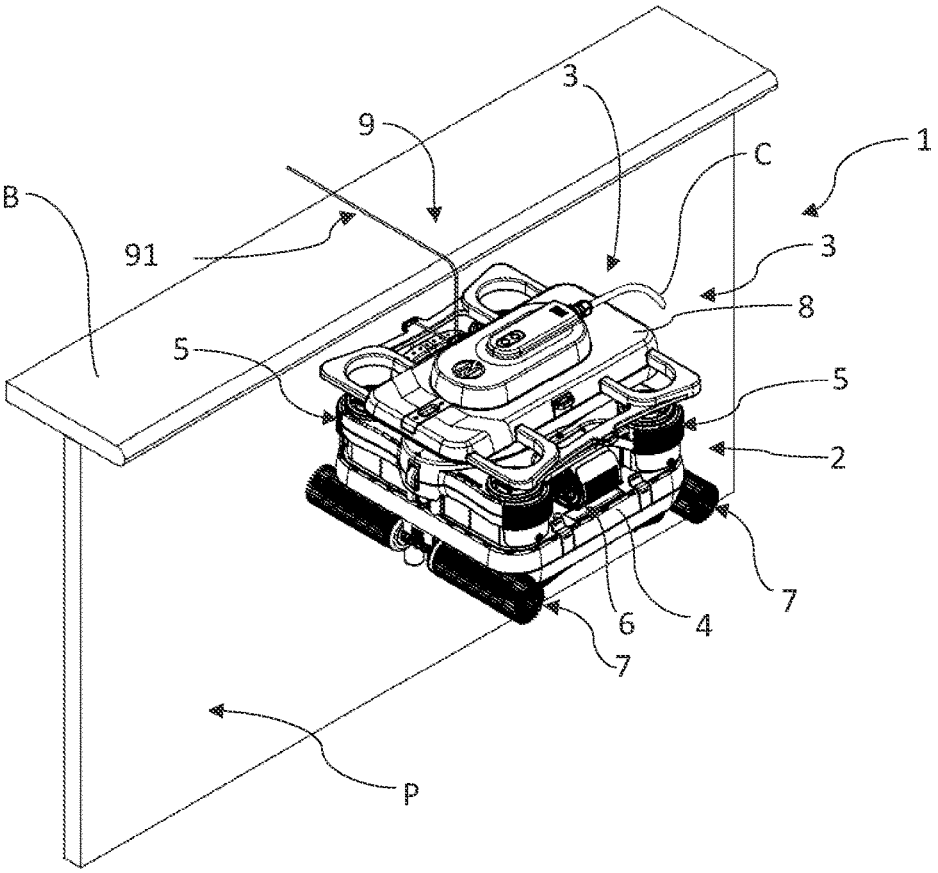
FIG. 4 is a schematic perspective view from above of the cleaning system of FIG. 1 in a different configuration of use.
Figure 5:
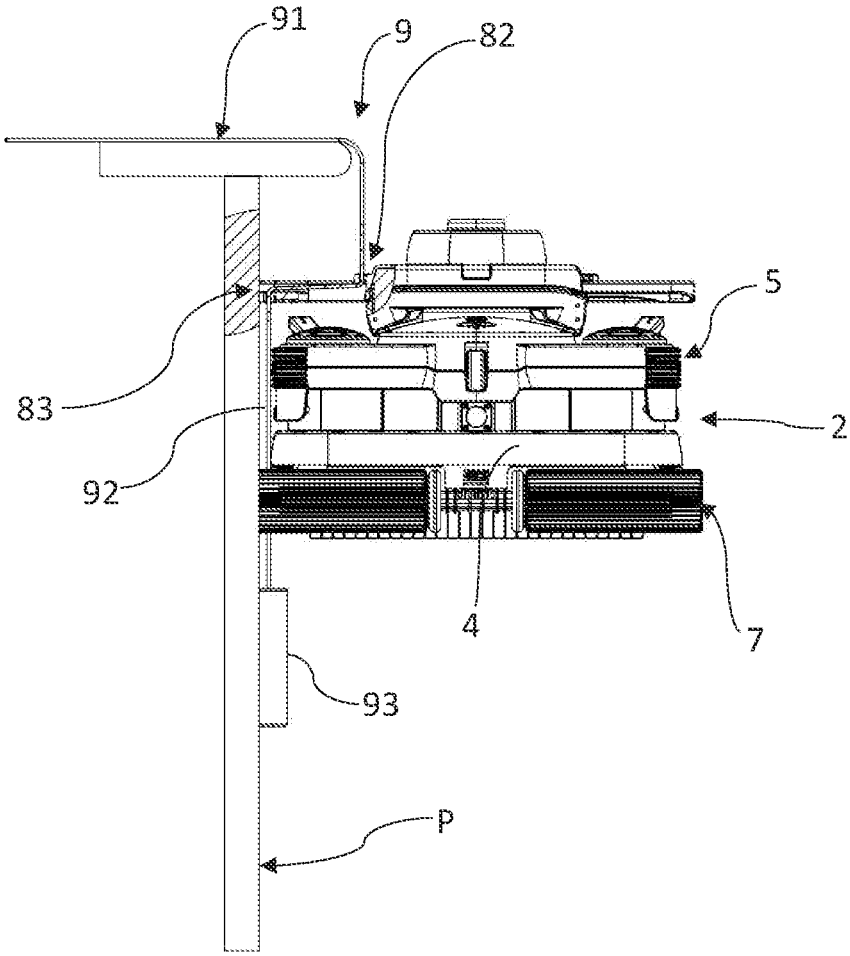
FIG. 5 is a schematic side elevation view of the cleaning system of FIG. 4.
Figure 6:
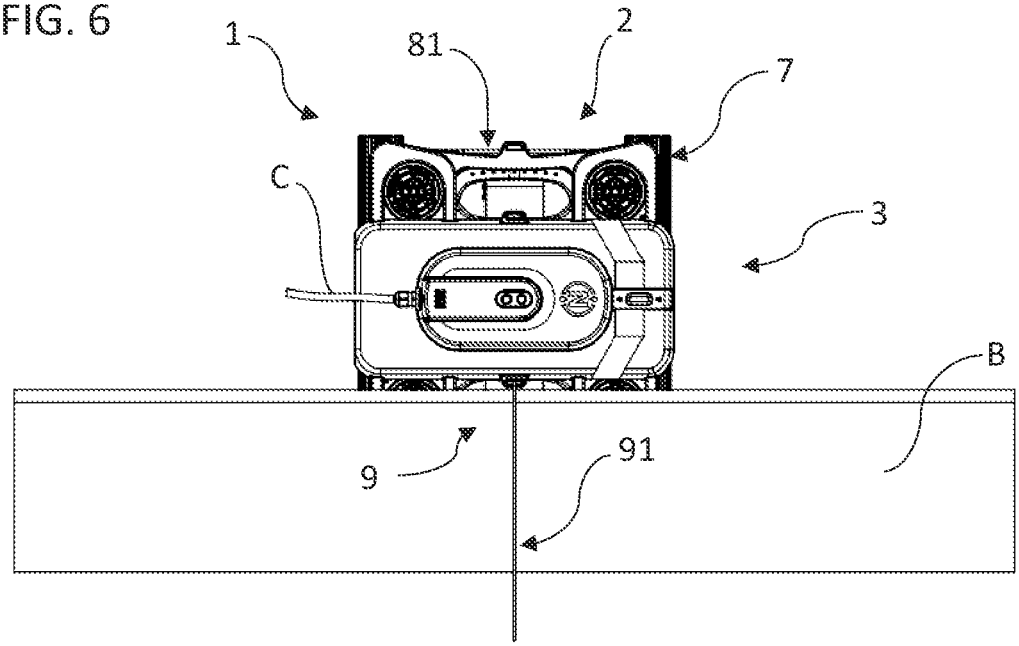
FIG. 6 is a top plan view of the cleaning system of FIGS. 4 and 6.

As illustrated by way of example in FIGS. 3 and 5, the two first and second engagement and movement elements 82, 83 allow an effective installation of the recharging base 8 both in the case of walls known as "infinity" walls or in any case without a projecting edge (FIG. 3), and in the case of walls with projecting edges B (FIG. 5).

After reaching the position, illustrated in the accompanying drawings, of engaging the robot 2 with the recharging base 8 the recharging of the electricity storage unit may be performed; the recharging being achieved by electrical coupling, advantageously of the inductive type.

In particular, the electricity supply is preferably supplied with a plug/socket coupling of the low voltage inductive type, to prevent any possible contact between metal parts and mains electricity supply in the presence of water.

An electrical cable C, illustrated schematically only in FIGS. 1, 3, 4 and 6, connected to the electricity network or to local generating sources (photovoltaic panels or the like) reaches the recharging base 8 at a respective access 13.

The recharging base 8 is supported by the flexible connecting element 9 to move relative to it along a vertical direction in its floating motion generated by variations in the height of the water surface.

In other words, the recharging base 8 is designed to adapt to variations in height, even instantaneous ones, of the surface of the water remaining close to the edge B thanks to the flexible connecting element 9.

For the purposes of the invention, the expression "floating motion" is used to mean the motion of a floating body following the variation of the level of the surface of water contained in the swimming pool.

FIGS. 7 to 12 illustrate an alternative embodiment, labelled 1', of the system 1 for cleaning swimming pools just described above with reference to FIGS. 1 to 6.

The system 1' differs from the system 1 just described basically with regard to its connection to the edge B of the swimming pool.

Figure 9:
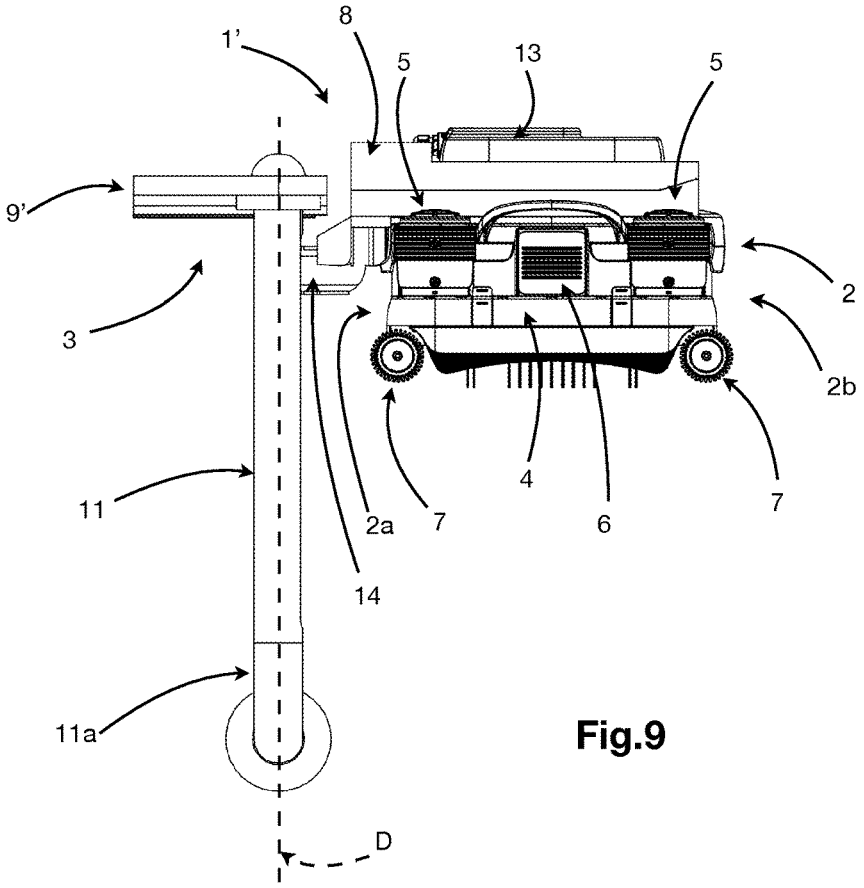
FIG. 9 is a schematic front elevation view of the cleaning system of the preceding drawings.
Figure 10:
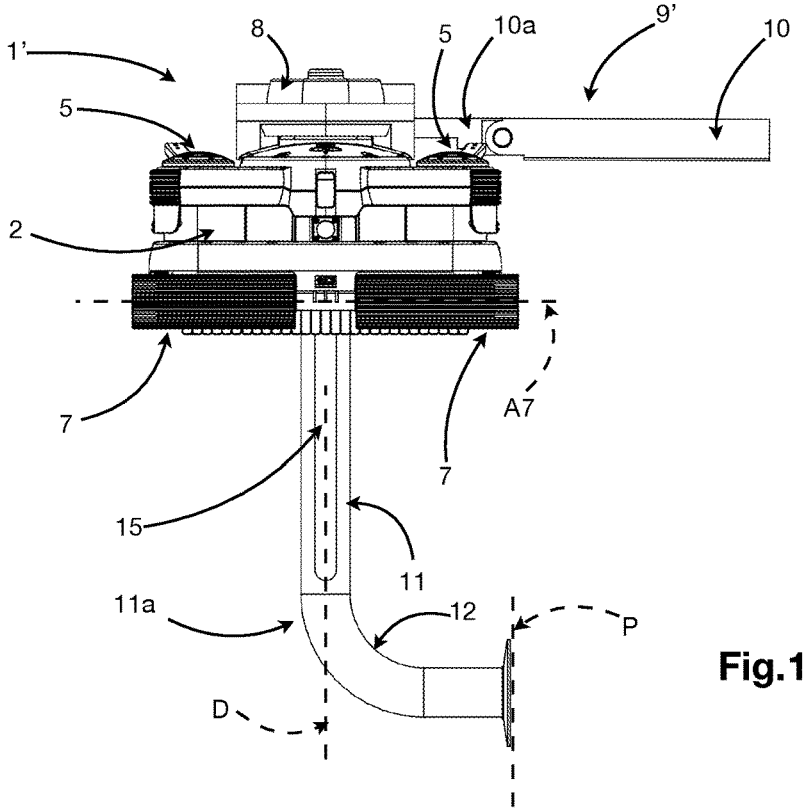
FIG. 10 is a schematic side elevation view of the cleaning system of the preceding drawings.
Figure 11:
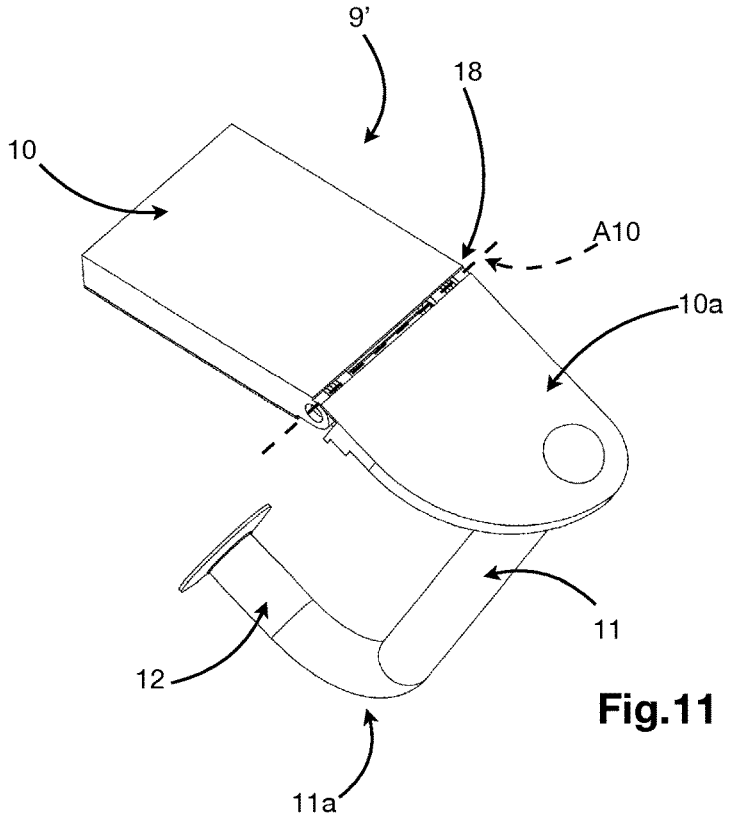
FIGS. 11 and 12 are two respective schematic perspective views from a different angle of a detail of detail of the cleaning system of the preceding drawings.
Figure 12:
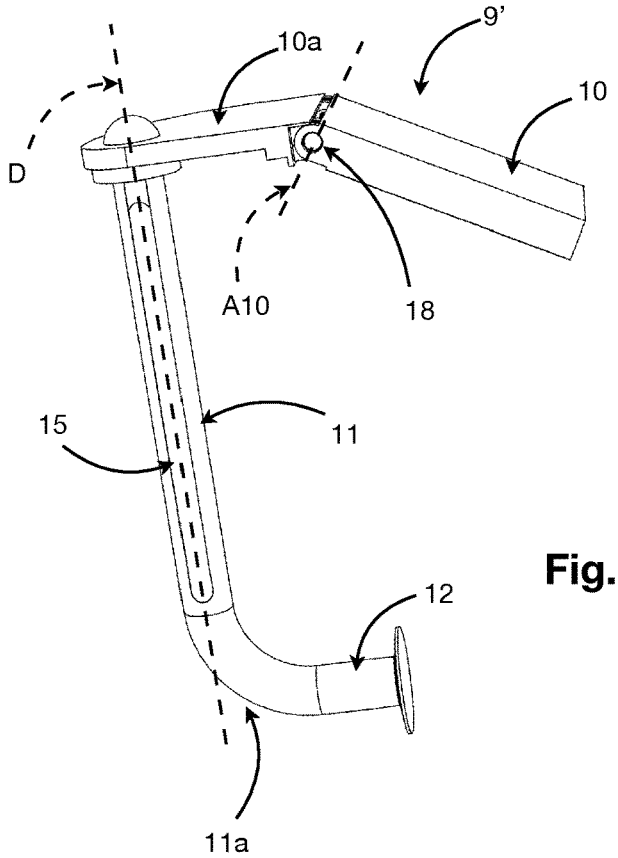

As clearly illustrated in particular in FIGS. 7, 9 and 10, the recharging station 3 of the system 1' comprises a connecting element 9' which is able to guarantee a stable connection of the recharging station 3 with an edge, not illustrated in these drawings, of the swimming pool.

The connecting element 9' comprises a first portion 10 defining a base designed to be positioned stably resting on an outer edge of the swimming pool and a second adjustable portion 10*a* to which is stably connected a supporting body 11 of the recharging base 8.

The second adjustable portion 10*a* is pivoted on the above-mentioned first portion 10 or base by means of a hinge 18 to move in a tilting fashion relative to a horizontal axis A10, in use substantially parallel to the surface of the water contained in the above-mentioned and not illustrated swimming pool.

The recharging station 3 also comprises a supporting body 11 for the recharging base 8, the supporting body 11 being integral with the above-mentioned connecting element 9' and starting from the latter extends longitudinally along a vertical direction D.

As clearly illustrated in FIGS. 7 and 10, the supporting body 11 has a lower end 11*a* configured to remain stably immersed in the water of the swimming pool and the lower end 11*a* has a striker portion 12 designed to be positioned resting against a vertical wall of the swimming pool, shown schematically in FIG. 10 with a dashed line P, to define a reference distance of the recharging base 8 from the vertical wall P.

The line P represents the outline on the plane of FIG. 10 of the above-mentioned vertical wall of the swimming pool.

Advantageously, as illustrated in the accompanying drawings, the above-mentioned striker portion 12 is L-shaped.

The rotation between the base 10 and the second portion 10*a* described above advantageously allows the connecting element 9' to be stably positioned on the edge of the swimming pool (edge which is very often inclined relative to the horizontal surface of the ground) while at the same time allowing the supporting body 11 to be positioned in the correct position, that is to say, vertical and with the striker portion 12 resting on the vertical wall of the swimming pool.

In other words, the possibility of mutually inclining the base 10 and the second portion 10*a* allows the supporting body 11 to be correctly positioned even in the presence of non-planar swimming pool edges or in any case with a particular shape and/or orientation.

Advantageously, the hinge 18 has, not illustrated, means for locking the hinge 18 configured to allow the selection of a preferred angle between the first portion 10 and the second portion 10*a* and stably maintains the angle selected.

Advantageously, the above-mentioned distance of the recharging base 8 from the vertical wall P adjusted by the striker portion 12 on the vertical wall P guarantees an easy return of the robot 2 towards the recharging base 8.

In effect, by using suitable sensors of substantially known type and not described further, the robot 2 is able to advance, in an immersed configuration and exploiting its buoyancy, in contact with the vertical wall P until reaching the recharging base 8 and engage with it also thanks to a possible guide zone, not visible in the accompanying drawings, made either on the robot 2 or on the recharging base 8.

After reaching the position, illustrated in the accompanying drawings, of engaging the robot 2 with the recharging base 8 the recharging of the electricity storage unit may be performed; the recharging being achieved by electrical coupling, advantageously of the inductive type.

In particular, the electricity supply is preferably supplied with a plug/socket coupling of the low voltage inductive type, to prevent any possible contact between metal parts and mains electricity supply in the presence of water.

An electrical cable not illustrated in FIGS. 7 to 12, connected to the electricity network or to local generating sources (photovoltaic panels or the like) reaches the recharging base 8 at a respective access 13.

The recharging base 8 is slidably connected to the supporting body 11 to move relative to it in the vertical direction D in its floating motion generated by variations in the height of the water surface.

In other words, the recharging base 8 is designed to slide vertically along the direction D to adapt to variations in height, even instantaneous one, of the water surface remaining anchored to the supporting body 11.

For the purposes of the invention, as mentioned, the expression "floating motion" is used to mean the motion of a floating body following the variation of the level of the surface of water contained in the swimming pool.

As illustrated in FIGS. 9 and 10, for the purpose of this slidable connection, the system 1' comprises a slider 14 integral with the recharging base 8 and a longitudinal slot 15 made in the supporting body 11, the above-mentioned slider 14 slidably engaging along the longitudinal slot 15.

The above-mentioned longitudinal slot 15 defines, for the supporting body 11, respective means, extending vertically, for guiding the vertical movement of the recharging base 8.

According to alternative embodiments, not illustrated, the above-mentioned guiding means comprise a track made on the supporting body 11.

Advantageously, the robot 2 comprises floating means designed to make it emerge on the surface without requiring any action by the rotors 5 which, on the other hand, will be used to move the robot 2 immersed at the desired height, also that corresponding to the bottom of the swimming pool.

The system 1, 1' according to the invention also comprises, advantageously, a movement sensor, not illustrated, positioned on the recharging base 8 and configured for measuring amplitude and/or frequency of the oscillations of the recharging base 8.

The sensor is in communication with the computerised command and control unit to which it signals excessive movement conditions of the recharging base 8 at which the robot 2, for example, is prevented from performing cleaning operations. In fact, if there are users immersed in the swimming pool, and the wave motion deriving from their movement constitutes evident proof, the robot 2 is advantageously inhibited from operation so as not to create discomfort or danger for the users.

Advantageously, the recharging base 8 and the robot 2 comprise magnetic elements, not illustrated, designed to engage with each other in a gripped fashion to prevent oscillations due to the movement of the water and/or the wind from causing the detachment of the robot 2 during the recharging step.

Advantageously, according to embodiments not illustrated, the robot 2 comprises inside it an antenna which is able to receive wireless signals. When the robot 2 is being recharged and/or in a relative static floating phase with motors switched off, the antenna (which may also be below the water level such that the angle of visibility of the sky still makes it possible to receive direct signals or reflected by transmission antennas) may receive commands from the recharging station 3 and/or from a radio-transmitter device of the user (mobile phone or remote control) and/or transmit information to the user.

In use, at the end of the operation for cleaning the swimming pool, or close to a lower charge limit of the electricity storage unit present in the robot 2, the robot 2 returns to a condition of floating on the surface of the water and reaches the recharging station 3.

The above-mentioned movements are controlled by the computerised command and control unit which controls the drive of the rotors 5, 6.

Advantageously, once the floating condition has been reached thanks to the stopping of the rotors 5 with a vertical axis, the robot 2 moves towards the recharging station 3 thanks to the combined action of the rotation rotors 6.

The recharging base 8, as mentioned above, is floating and remains constantly on the surface of the water contained in the swimming pool. This behaviour of the recharging base 8 allows it to be at the correct height for receiving the robot 2, which is also floating.

Advantageously, moreover, the fact that the recharging base 8 engages with the flexible connecting element 9, 9', whether of a flexible or non-flexible type, means that the base 8 maintains, in plan view relative to the swimming pool, the same positioning, thus facilitating its localization by the robot 2 when it must reach it to prepare for the recharging step.

The system 1, 1' for cleaning swimming pools according to the invention overcomes the above-mentioned drawbacks and brings important advantages.

A first advantage linked to the invention is due to the fact that the cleaning system does not require any intervention by an operator relative to the recharging step.

A further advantage linked to the system according to the invention is due to its constructional simplicity and its ease of installation, which basically does not require any external structure or infrastructure, as it can simply be rested along the edge of the swimming pool.

The invention claimed is:

1. A swimming pool cleaning system comprising a robot comprising:

a main body, a plurality of electrically driven rotors supported by said main body and configured to generate a hydrodynamic thrust configured to move the robot inside a volume of water of a swimming pool, an electricity storage unit for powering said rotors, a swimming pool cleaning device;

a recharging base for recharging said electricity storage unit, said recharging base being floating and configured to remain stably at the water surface of the volume of water of said swimming pool, a recharging station, said recharging base being integrated in said recharging station, said recharging station comprising a connecting element configured to allow a stable connection with an edge of the swimming pool.

2. The swimming pool cleaning system according to claim 1, wherein said connecting element is a flexible connecting element.

3. The swimming pool cleaning system according to claim 2, wherein said flexible connecting element is one of a cable, a cord, a belt, a chain with rings and an articulated chain.

4. The swimming pool cleaning system according to claim 2, wherein said flexible connecting element has a lower portion to be immersed in the water in use and, at said lower portion, comprises a weight configured to keep under tension said flexible connecting element.

5. The swimming pool cleaning system according to claim 1, wherein said recharging station comprises a supporting body for supporting said recharging base, said supporting body being integral with said connecting element and extending longitudinally therefrom according to a vertical direction, said recharging base being slidingly connected to said supporting body to move with respect thereto according to said vertical direction in a floating motion caused by variations in a height of the water surface.

6. The swimming pool cleaning system according to claim 5, wherein said connecting element comprises a base configured to be positioned resting stably on an outer edge of said swimming pool.

7. The swimming pool cleaning system according to claim 6, wherein said connecting element comprises an adjustable portion pivoted on said base to move in a tilting fashion relative to a horizontal axis, said supporting body being integral with said adjustable portion.

8. The swimming pool cleaning system according to claim 5, wherein said supporting body includes a guiding track for guiding a vertical movement of said recharging base, said guiding track extending longitudinally, and said recharging base has a slider configured to slidably engage with said guiding track.

9. The swimming pool cleaning system according to claim 8, wherein said guiding track comprises a longitudinal slot made in said supporting body along which said longitudinal slot slidably engages said slider integral with said recharging base.

10. The swimming pool cleaning system according to claim 5, wherein said supporting body has a lower end configured to maintain itself stably immersed in the water of said swimming pool in use, wherein said lower end has a striker portion configured to be positioned resting against a vertical wall of said pool to define a reference distance of the recharging base from said vertical wall.

11. The swimming pool cleaning system according to claim 10, wherein said striker portion is "L" shaped.

12. The swimming pool cleaning system according to claim 1, and further comprising a motion sensor positioned on said recharging base and configured to detect amplitude and/or frequency of oscillations of said recharging base.

13. The swimming pool cleaning system according to claim 1, wherein said robot includes a float configured to allow said robot to reach a level of the water surface and maintain the level of the water surface even absent power.

* * * * *